US009219330B2

(12) United States Patent
Shin

(10) Patent No.: US 9,219,330 B2
(45) Date of Patent: Dec. 22, 2015

(54) ANGLE ADJUSTABLE EAR JACK DEVICE

(71) Applicant: Samsung Electronics Co. Ltd., Suwon-si, Gyeonggi-do (KR)

(72) Inventor: Yunsung Shin, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 216 days.

(21) Appl. No.: 13/922,480

(22) Filed: Jun. 20, 2013

(65) Prior Publication Data

US 2013/0344732 A1 Dec. 26, 2013

(30) Foreign Application Priority Data

Jun. 21, 2012 (KR) ..... 10-2012-0066818

(51) Int. Cl.
*H01R 13/60* (2006.01)
*H01R 24/58* (2011.01)
*H01R 35/04* (2006.01)

(52) U.S. Cl.
CPC ..... *H01R 13/60* (2013.01); *H01R 24/58* (2013.01); *H01R 35/04* (2013.01)

(58) Field of Classification Search
CPC ..... H01R 29/00; H01R 13/518; H01R 24/58; H01R 23/025
USPC ..... 439/170, 534, 668, 669, 954
See application file for complete search history.

(56) References Cited

U.S. PATENT DOCUMENTS

| | | | | |
|---|---|---|---|---|
| 4,099,823 | A * | 7/1978 | D'Alessio | 439/491 |
| 5,639,261 | A * | 6/1997 | Rutkowski et al. | 439/534 |
| 6,050,853 | A * | 4/2000 | Ando et al. | 439/607.02 |
| 6,537,106 | B1 * | 3/2003 | Follingstad | 439/534 |
| 7,335,056 | B1 * | 2/2008 | Clark et al. | 439/540.1 |
| 7,455,548 | B2 * | 11/2008 | Clark et al. | 439/534 |
| 7,874,869 | B2 * | 1/2011 | Chern et al. | 439/544 |
| 7,901,236 | B2 * | 3/2011 | Patchett | 439/354 |
| 8,123,569 | B2 * | 2/2012 | Little et al. | 439/669 |
| 8,287,314 | B1 * | 10/2012 | Gao et al. | 439/668 |
| 8,585,445 | B2 * | 11/2013 | Deehr et al. | 439/669 |
| 2006/0183368 | A1 | 8/2006 | Kim | |
| 2010/0144208 | A1 | 6/2010 | Huang et al. | |
| 2011/0170734 | A1 | 7/2011 | Lim | |

FOREIGN PATENT DOCUMENTS

| | | | |
|---|---|---|---|
| DE | 202009011478 | U1 | 2/2010 |
| EP | 2466696 | A1 | 6/2012 |
| JP | 2005093219 | A | 4/2005 |
| KR | 10-2006-0066487 | A | 6/2006 |
| KR | 10-2011-0081913 | A | 7/2011 |
| WO | 2012059055 | A1 | 5/2012 |

* cited by examiner

*Primary Examiner* — Thanh Tam Le
(74) *Attorney, Agent, or Firm* — Jefferson IP Law, LLP

(57) ABSTRACT

An ear jack device capable of adjusting an angle of the ear jack is provided. The angle adjustable ear jack device includes an ear jack unit capable of an angle adjustment, an ear jack support unit for adjusting the angle of the ear jack unit, and at least one hinge for assembling the ear jack unit and the ear jack support unit.

18 Claims, 14 Drawing Sheets

ANGLE ADJUSTABLE EAR JACK DEVICE

PRIORITY

This application claims the benefit under 35 U.S.C. §119(a) of a Korean patent application filed on Jun. 21, 2012 in the Korean Intellectual Property Office and assigned Serial No. 10-2012-0066818, the entire disclosure of which is hereby incorporated by reference.

BACKGROUND

1. Technical Field

The present disclosure relates to an ear jack device used in an electronic device. More particularly, the present disclosure relates to an angle adjustable ear jack device capable of adjusting an angle of the ear jack.

2. Description of the Related Art:

In order to make a sound or transmit sound to a user through an external speaker such as an earphone or a headphone instead of a built-in speaker in an electronic device, the electronic device requires an ear jack. Generally, the ear jack is a device for connecting a plug of an external device (e.g., an earphone) to the electronic device.

The plug is generally a metal portion for transmitting and receiving a sound signal and/or an electric signal between the electronic device and the earphone. For example, when the earphone plug is inserted into the ear jack, by contacting with the metal portion within the ear jack, the earphone plug transfers an electric signal including a sound signal of the electronic device to an earphone or transfers a sound signal and an electric signal of the earphone through, for example a built-in microphone of the earphone to the electronic device.

The metal portion for transferring an electric signal can be built into an ear jack by an insert injection method. There are two conventional methods of mounting an ear jack having the metal portion in a Printed Circuit Board (PCB). One is to use a Surface-Mount Device (SMD) and the other is to use a separate component like a Flexible Printed Circuit Board (FPCB).

FIGS. 1A and 1B are perspective views illustrating an ear jack mounted at one surface of a PCB by using the SMD according to the related art.

Referring to FIG. 1A, once the conventional ear jack 12 is mounted in the PCB 10, the conventional ear jack 12 cannot be moved in any direction because it is fixed to the PCB. Further, as shown in FIG. 1B, the angle of an earphone plug 20 cannot be adjusted to correspond to a design shape or the external appearance of the electronic device. For instance, when the electronic device is designed as having a rounded-shape surface 30, the earphone plug 20 is still horizontally inserted into the ear jack 12. Even though the earphone plug 20 is completely inserted into the ear jack 12, a portion of the earphone plug 22 remains exposed to the outside. Therefore, a user can misunderstand that the earphone plug 20 is not completely inserted into the ear jack 12 and thus the user may forcibly further push the earphone plug 20 into the ear jack 12. As a result of the forcible insertion, components can be damaged and malfunction may occur.

FIGS. 2A and 2B are perspective views illustrating an obliquely mounted ear jack having a separate FPCB 14 according to the related art.

FIGS. 2A and 2B illustrate a state in which an insertion angle of the ear jack 12 is inclined to correspond to an external appearance or design (e.g., a rounded-shape surface design) of an electronic device as an alternative for addressing the problem described with reference to FIGS. 1A and 1B. However, because the ear jack 12 should be connected to the PCB 10 using a separate component like the FPCB 14, this approach increases production costs and requires increased assembly time.

Therefore a need exists for an improved ear jack device capable of angle adjustment.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an angle adjustable ear jack device that can adjust the insertion angle of an earphone plug according to an external appearance design of an electronic device.

Another aspect of the present disclosure is to prevent components from being damaged and causing malfunctions as a result of unnecessary further forcible insertion.

Another aspect of the present disclosure is to provide an angle adjustable ear jack device that enhances the capability of component sharing and reducing production costs of the electronic device through standardization of an ear jack.

In accordance with an aspect of the present disclosure, an angle adjustable ear jack device is provided. The device includes an ear jack unit capable of an angle adjustment, an ear jack support unit for adjusting the angle of the ear jack unit, and at least one hinge for assembling the ear jack unit and the ear jack support unit.

In accordance with another aspect of the present disclosure, two or more fixing portions are positioned at both sides of the ear jack, and the fixing portion is bonded to an angle adjustment hole positioned at the ear jack support and fixes an angle of the ear jack.

In accordance with another aspect of the present disclosure, the conductive elastic member maintains a contact with the land pad, and the length of the conductive elastic member increases or decreases according to a change in an angle of the ear jack.

Other aspects, advantages, and salient features of the disclosure will become apparent to those skilled in the art from the following detailed description, which, taken in conjunction with the annexed drawings, discloses exemplary embodiments of the disclosure.

BRIEF DESCRIPTION OF THE DRAWINGS

The above and other aspects, features, and advantages of certain exemplary embodiments of the present disclosure will be more apparent from the following detailed description in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

The following description with reference to the accompanying drawings is provided to assist in a comprehensive understanding of exemplary embodiments of the disclosure as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of exemplary embodiments of the present disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Technical features disclosed herein in connection with an angle adjustable ear jack device of exemplary embodiments of the present disclosure can be applied to any connector device for connecting a peripheral or external device to a host device.

For conciseness of explanation, the following exemplary embodiments illustrate an earphone plug, however, the scope of the present disclosure is not limited to the earphone plug and can be applied to entire devices having a plug that can transmit and receive a sound signal and/or an electric signal with the ear jack.

Further, a shape of components including an ear jack unit, an ear jack support unit, a fixing portion, and a hinge used in exemplary embodiments of the present invention are merely exemplary, and thus the present disclosure is not limited thereto.

Figure 1B:
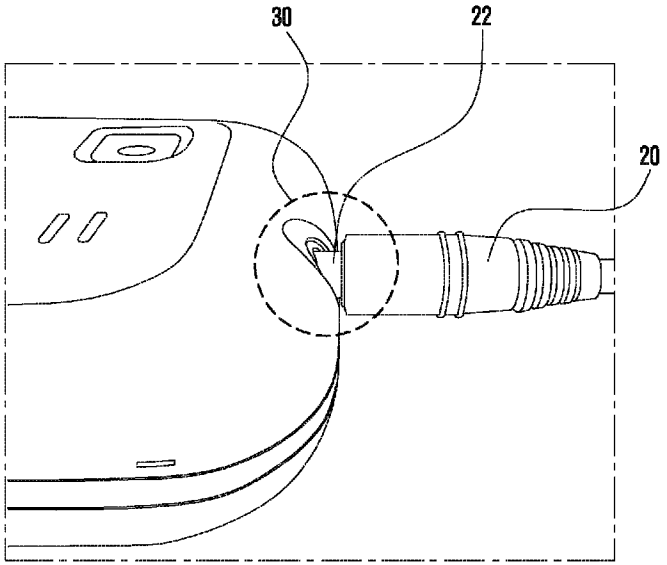
FIGS. 1A and 1B are perspective views illustrating an example of mounting an ear jack in one surface of a Printed Circuit Board (PCB) according to the related art.
Figure 1A:
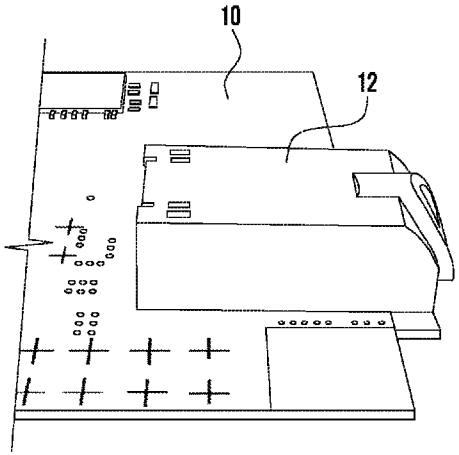
Figure 2B:
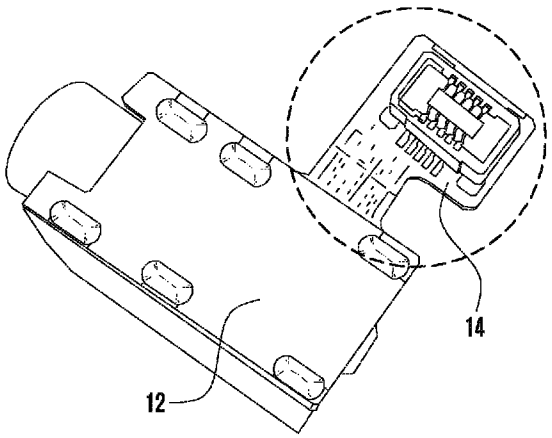
FIGS. 2A and 2B are perspective views illustrating an example of obliquely mounting an ear jack to a Flexible Printed Circuit Board (FPCB) by using a separate FPCB according to the related art.
Figure 2A:
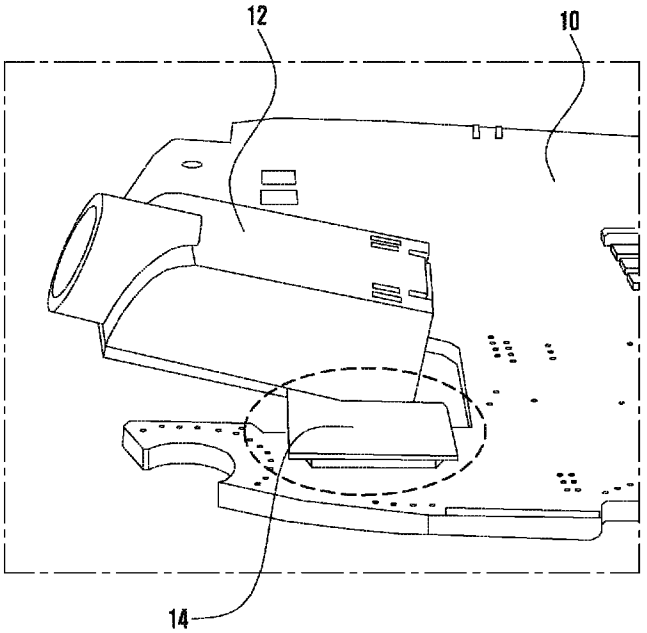
Figure 3A:
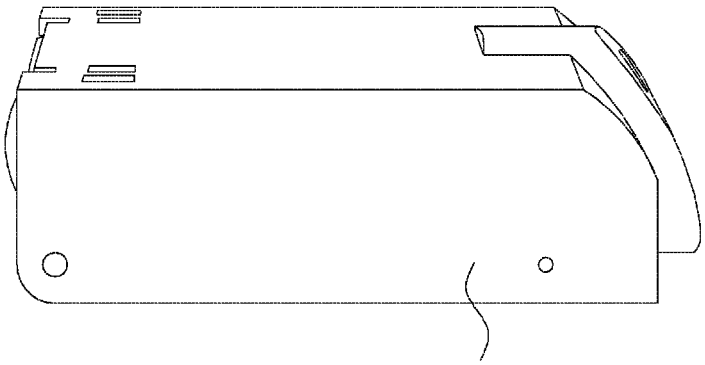
FIGS. 3A and 3B are perspective views illustrating an ear jack and a fixing portion according to an exemplary embodiment of the present disclosure.
Figure 3B:
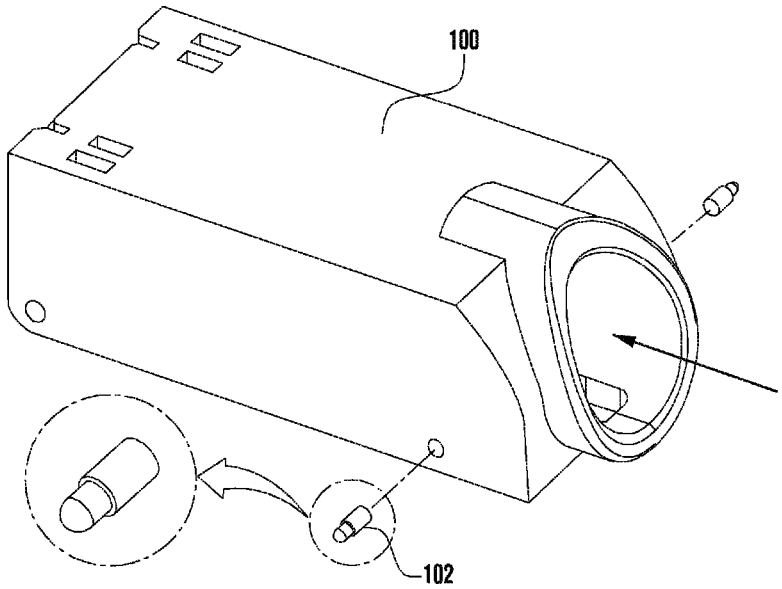

FIGS. 3A and 3B are perspective views illustrating an ear jack and a fixing portion according to an exemplary embodiment of the present disclosure.

Referring to FIGS. 3A and 3B, in the ear jack 100, at least two fixing portions 102 are installed at both side of the ear jack 100. The fixing portion 102 is used for fixing an angle of the ear jack 100 according to an external appearance or design of an electronic device. A position of the fixing portion 102 is not limited to one location of the ear jack 100 and may be changed to, or positioned at, various locations as needed.

Further, the fixing portion 102 may comprise various fixing members including a pogo pin. Further, the shape of the fixing portion 102 is not limited to the shape described in FIGS. 3A and 3B. In exemplary embodiments, a variety of shapes can be used.

Figure 4:
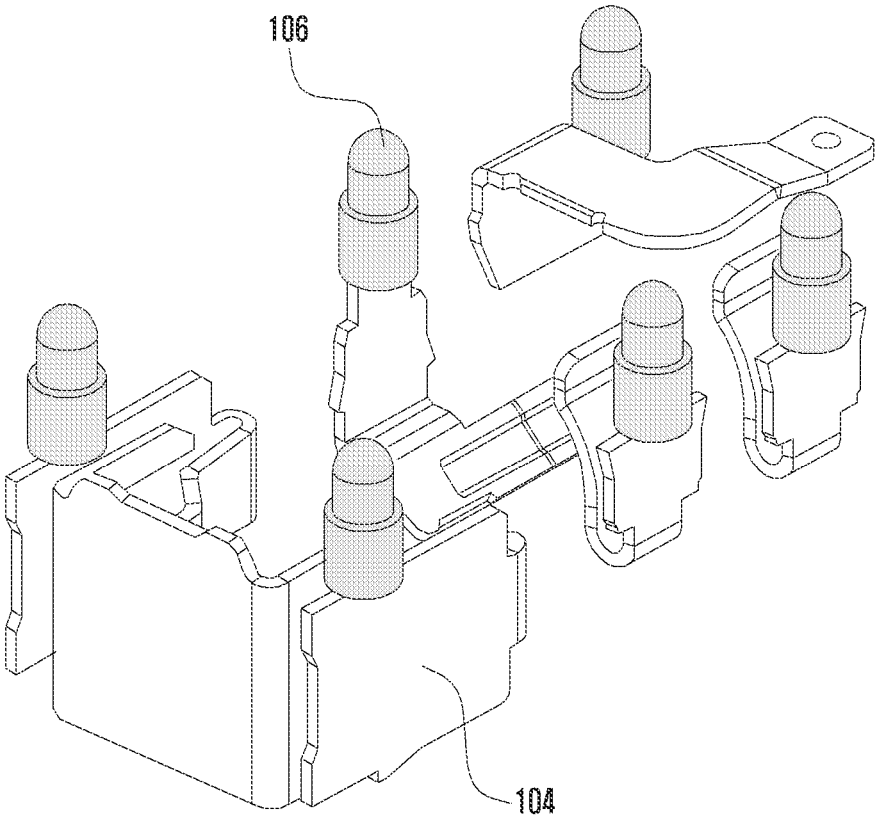
FIG. 4 is a perspective view illustrating a conductive elastic member and a metal portion that transfer an electric signal to other devices or to a land pad according to an exemplary embodiment of the present disclosure.

FIG. 4 is a perspective view illustrating a conductive elastic member and a metal portion that transfer an electric signal to other devices or to a land pad according to an exemplary embodiment of the present disclosure.

Referring to FIG. 4, the conductive elastic member 106 and the metal portion 104 shown in FIG. 4 can be housed within the ear jack by an insert injection molding method. The conductive elastic member 106 includes a pogo pin and may be formed with various members having conductivity and an elastic force. The length of the conductive elastic member 106 increases or decreases according to change in a pressure and/or an angle applied to the ear jack 100.

Figure 5:
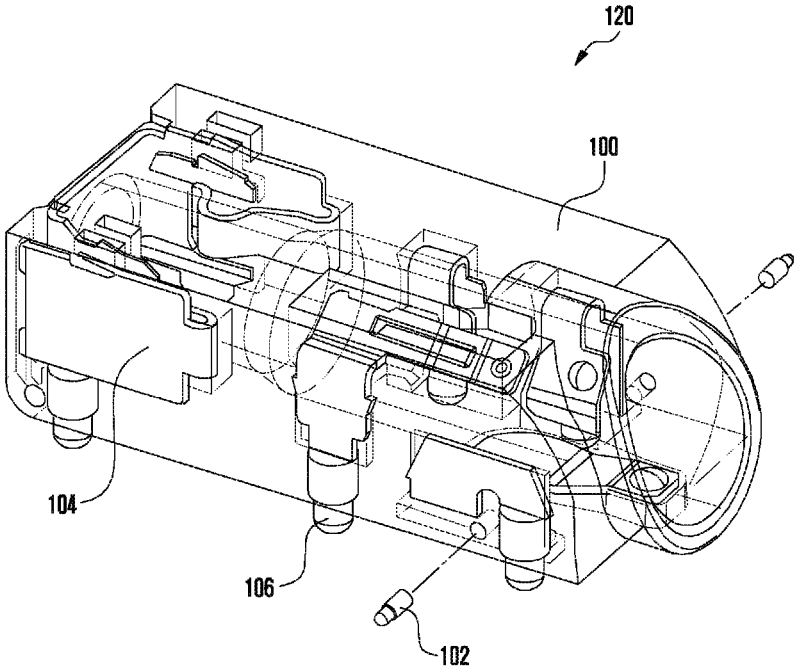
FIG. 5 is a perspective view illustrating an ear jack unit in which an ear jack, a fixing portion, a conductive elastic member, and a metal portion are assembled together in relation to FIGS. 3A and 3B and FIG. 4 according to an exemplary embodiment of the present disclosure.

FIG. 5 is a perspective view illustrating an ear jack unit in which an ear jack, a fixing portion, a metal portion, and a conductive elastic member are assembled together in relation to FIGS. 3A and 3B and FIG. 4 according to an exemplary embodiment of the present disclosure.

Referring to FIG. 5, the fixing portion 102, the metal portion 104, and the conductive elastic member 106 can be housed in the ear jack 100 of the ear jack unit 120 by using an insert injection molding method.

Figure 6B:
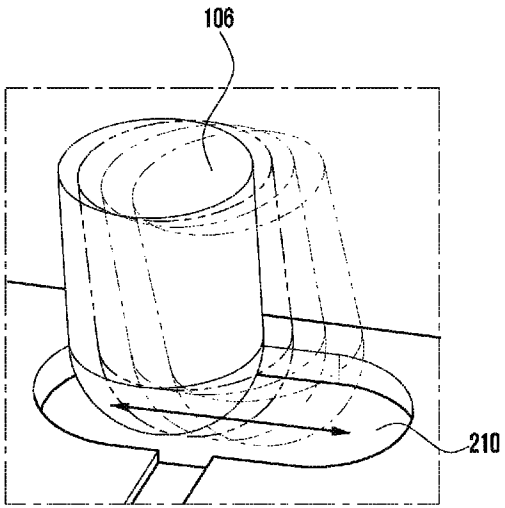
FIGS. 6A and 6B are perspective views illustrating a land pad and a contact land that transfer an electric signal of an ear jack to a PCB according to an exemplary embodiment of the present disclosure.
Figure 6A:
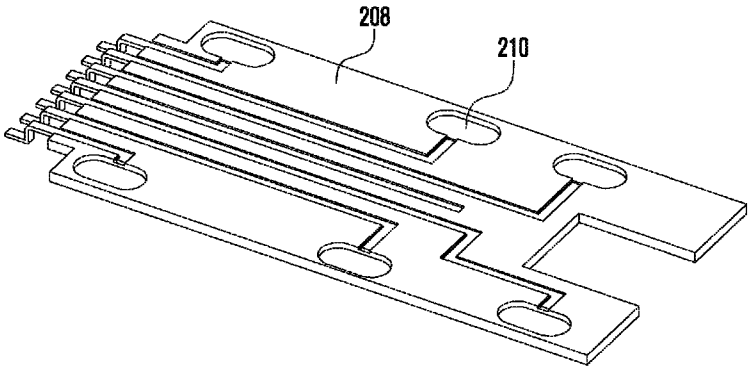

FIGS. 6A and 6B are perspective views illustrating a land pad and a contact land that transfer an electric signal of the ear jack to a Printed Circuit Board (PCB) according to an exemplary embodiment of the present disclosure.

Referring to FIGS. 6A and 6B, a contact land 210 for maintaining a contact with the conductive elastic member 106 in relation to FIG. 5 is shown. The land pad 208 shown in FIG. 6A performs a function of transferring an electric signal of the ear jack unit 120 to the PCB or transferring a sound signal and/or an electric signal generated in an electronic device to the ear jack unit 120 shown in FIG. FIG. 5. The land pad 208 includes a plurality of contact lands 210.

Referring to FIG. 6B, the conductive elastic member 106 housed in the ear jack 100 maintains contact with the contact land 210 even if an angle of the ear jack unit 120 is changed. In order to maintain the contact with the conductive elastic member 106, the contact land 210 may have a characteristic of being extended in a lengthwise direction. When an angle of the ear jack unit 120 is changed, the length of the conductive elastic member 106 may increase or decrease. Contact of the elastic member 106 and the contact land 210 moves in a direction depicted by the arrow shown in FIG. 6B, thereby maintaining a stable and continuous contact between the conductive elastic member 106 and the contact land 210.

Figure 7:
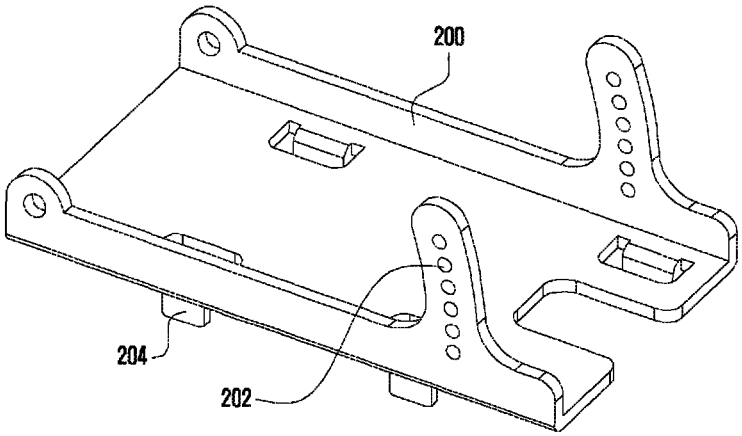
FIG. 7 is a perspective view illustrating an ear jack plate to be disposed at a PCB according to an exemplary embodiment of the present disclosure.

FIG. 7 is a perspective view illustrating an ear jack plate to be disposed at a PCB according to an exemplary embodiment of the present disclosure.

Referring to FIG. 7, the ear jack plate 200 is generally made of a Sustain (SUS) press with a metal material and corresponds to a frame in which the ear jack unit 120 is assembled. The ear jack plate 200 may have at least one mounting portion 204 that would be used to mount the ear jack plate in the PCB using a Surface Mount Device (SMD). The position and shape of the mounting portion 204 may be changed according to a type (e.g., on-board or pc-cutting type) as described later. Further, the ear jack plate 200 may have an angle adjustment hole 202 for adjusting an angle of the ear jack unit 120 by bonding to the fixing portion 102 positioned at both side of the ear jack 100. A distance, a size, and the number of the angle adjustment hole 202 may be changed according to a product. The shape of the adjustment hole is not limited to the shape described in FIG. 7. Its shape can be modified in accordance with the shape of the fixing portion 102.

Figure 8:
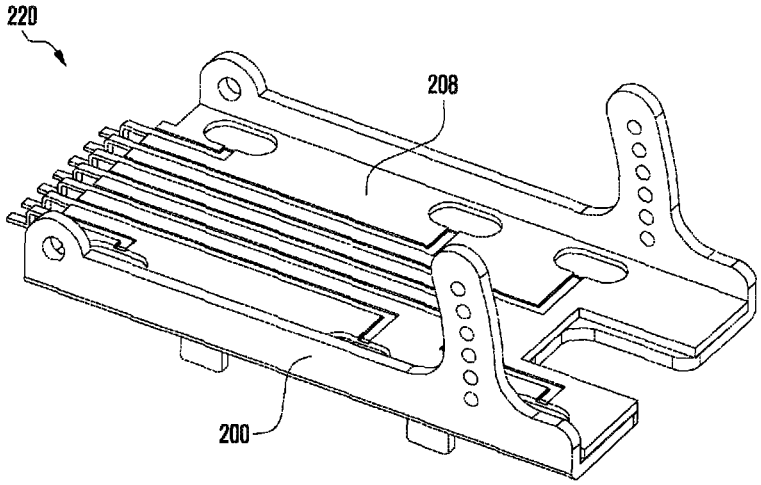
FIG. 8 is a perspective view illustrating an ear jack support unit in which an ear jack plate and a land pad are assemble together in relation to FIGS. 6A and 6B and FIG. 7 according to an exemplary embodiment of the present disclosure.

FIG. 8 is a perspective view illustrating an ear jack support unit in which an ear jack plate and a land pad are assemble together in relation to FIGS. 6A and 6B and FIG. 7 according to an exemplary embodiment of the present invention.

Referring to FIG. 8, ear jack plate 200 of ear jack support unit 220 and land pad 208 are shown as assembled according to an exemplary embodiment of the present disclosure.

Figure 9A:
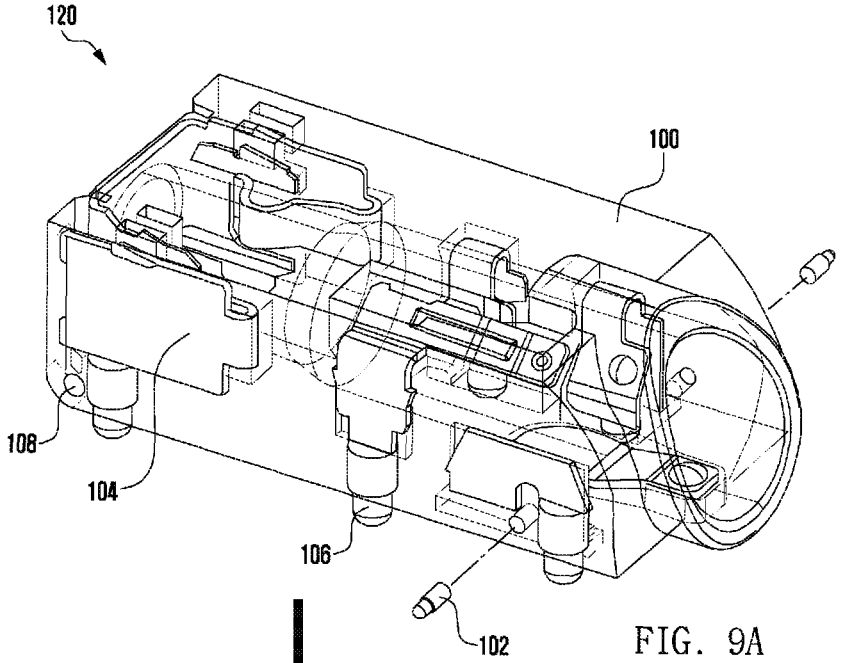
FIGS. 9A and 9B are exploded perspective views illustrating an ear jack unit and an ear jack support unit assembled by a hinge in relation to FIG. 3A to FIG. 8 according to an exemplary embodiment of the present disclosure.
Figure 9B:
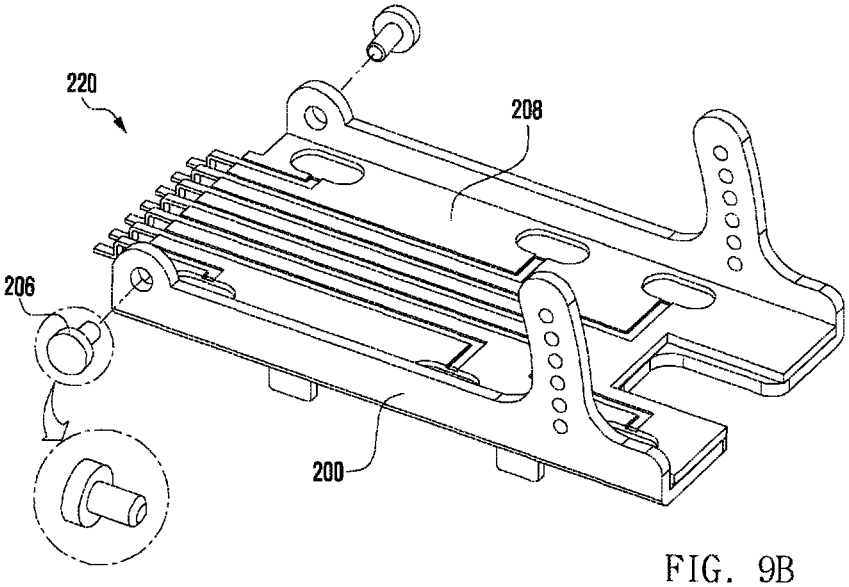

FIGS. 9A and 9B are exploded perspective views illustrating an ear jack unit and an ear jack support unit assembled by a hinge in relation to FIGS. 3A to FIG. 8 according to an exemplary embodiment of the present disclosure.

Referring to FIGS. 9A and 9B, the hinge 206 functions as a rotation axis when an angle of the ear jack unit 120 is changed. When the ear jack unit 120 and the ear jack support unit 220 are assembled, the hinge 206 is inserted into a hinge hole 108 of the ear jack unit 120.

Figure 10:
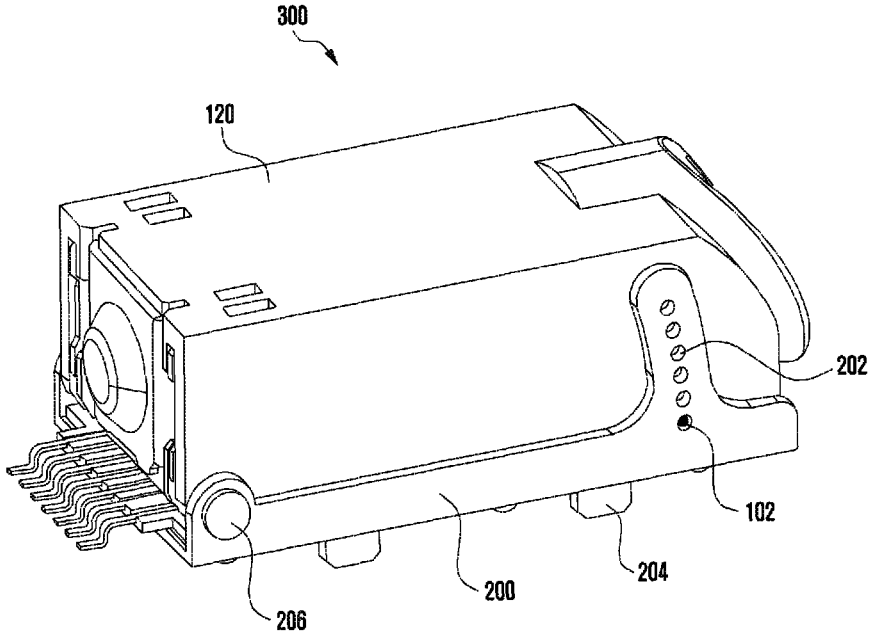
FIG. 10 is a perspective view illustrating an angle adjustable ear jack device in which an ear jack unit and an ear jack support unit are assembled in relation to FIGS. 9A and 9B according to an exemplary embodiment of the present disclosure.

FIG. 10 is a perspective view illustrating an angle adjustable ear jack device in which an ear jack unit and an ear jack support unit are assembled in relation to FIGS. 9A and 9B according to an exemplary embodiment of the present disclosure.

Referring to FIG. 10, the ear jack unit 120 and the ear jack support unit 220 are coupled by the hinge 206, and the fixing portion 102 is bonded to the angle adjustment hole 202 of the ear jack plate 200 having mounting portion 204.

Figure 11A:
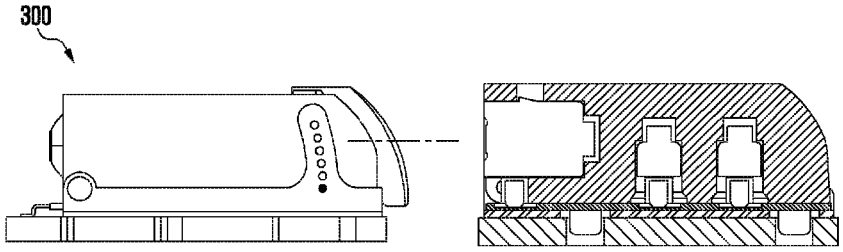
FIGS. 11A to 11C are cross-sectional views illustrating change in an angle of an angle adjustable ear jack device mounted in a PCB according to an exemplary embodiment of the present disclosure.
Figure 11B:
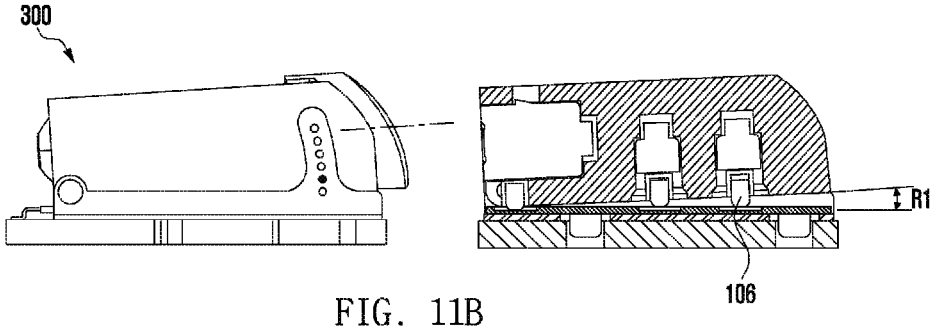
Figure 11C:
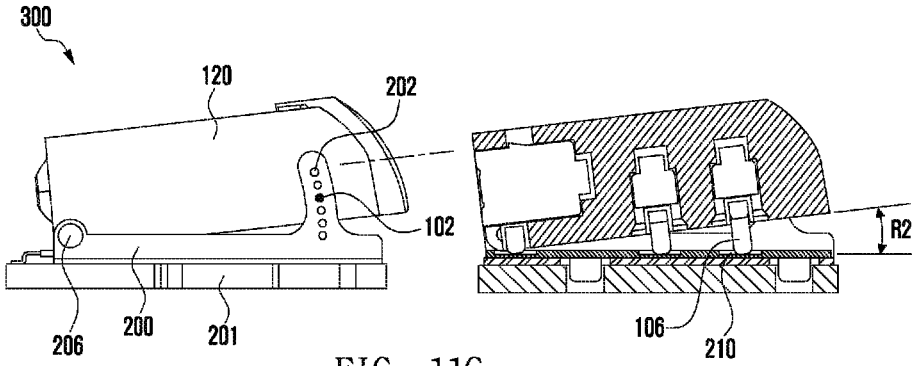

FIGS. 11A to 11C are cross-sectional views illustrating change in an angle of the angle adjustable ear jack device mounted in a PCB according to an exemplary embodiment of the present disclosure.

FIG. 11A illustrates an angle adjustable ear jack device 300 mounted in a PCB 201 in a horizontal state. FIG. 11B illustrates an ear jack unit 120 with an angle R1 compared with FIG. 11A. FIG. 11C illustrates the ear jack unit 120 with an increased angle R2 compared with FIG. 11B.

Referring to FIGS. 11A to 11C, the ear jack unit 120 rotates in a center of the hinge 206 of the ear jack plate 200. The fixing portion 102 fixes an angle of the ear jack unit 120 by bonding to the angle adjustment hole 202 in correspondence with the angle (e.g., R1 and R2). In comparison with FIG. 11A, FIG. 11B shows the angle adjustable ear jack device with a certain angle (R1). The fixing portion 102 is bonded to an angle adjustment hole which is different from the adjustment hole depicted in FIG. 11A. FIG. 11C illustrates an exemplary embodiment that has a bigger angle (R2) than the angle R1 in FIG. 11B. The fixing portion 102 is bonded to a different angle adjustment hole in correspondence with the angle R2.

Further, FIGS. 11A to 11C also illustrate change in the length of the conductive elastic member 106 in accordance with the angle change of the ear jack unit 120 according to exemplary embodiments of the present disclosure. The conductive elastic member 106 continues to maintain a contact with the contact land 210. When an angle of the ear jack unit 120 changes from R2 to R1, the length of the conductive elastic member 106 may decrease in accordance with the angle change.

Figure 12A:
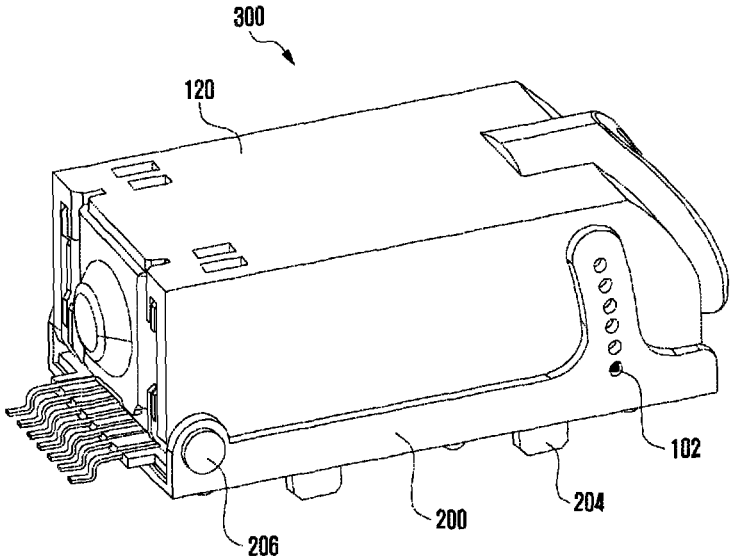
FIGS. 12A and 12B are perspective views illustrating an angle adjustable ear jack device in an on-board type according to an exemplary embodiment of the present disclosure.
Figure 12B:
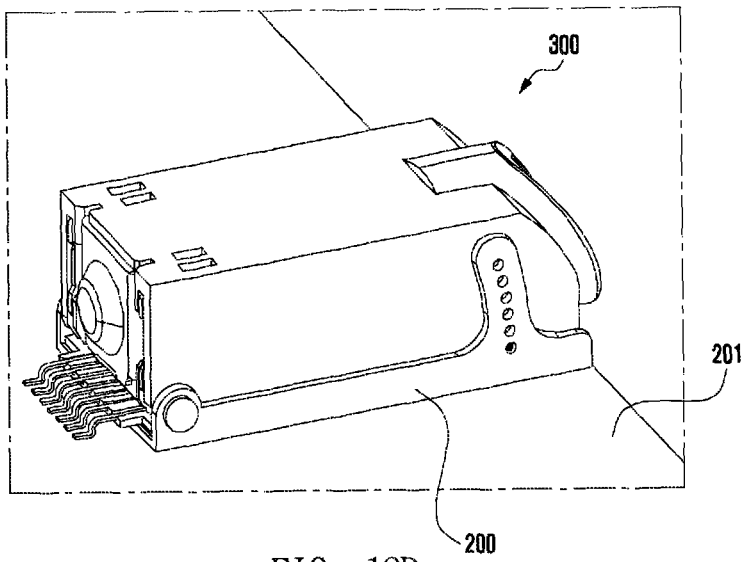

FIGS. 12A and 12B are perspective views illustrating an angle adjustable ear jack device mounted in an on-board type according to an exemplary embodiment of the present disclosure.

Referring to FIGS. 12A and 12B, an exemplary angle adjustable ear jack device 300 is described below in connection with FIGS. 13A to 13C.

Figure 13A:
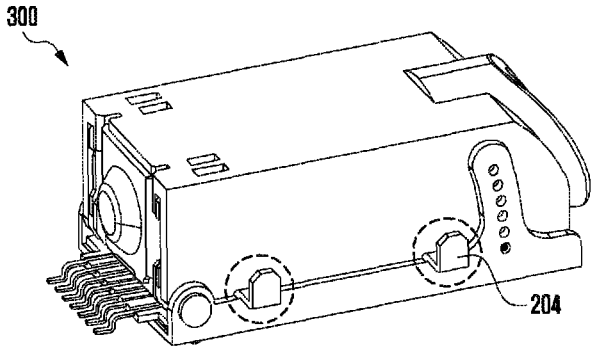
FIGS. 13A to 13C are perspective views illustrating an angle adjustable ear jack device mounted in a PCB-cutting type according to an exemplary embodiment of the present disclosure.
Figure 13B:
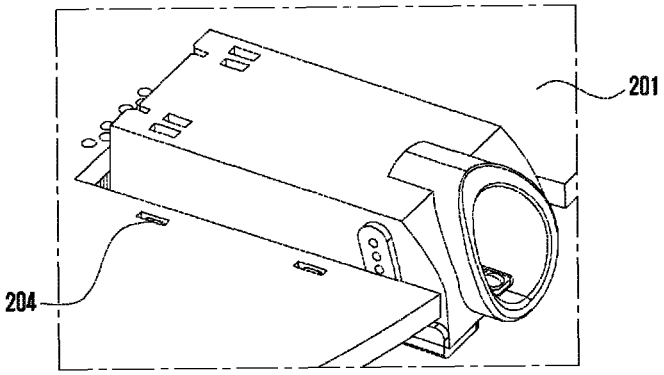
Figure 13C:
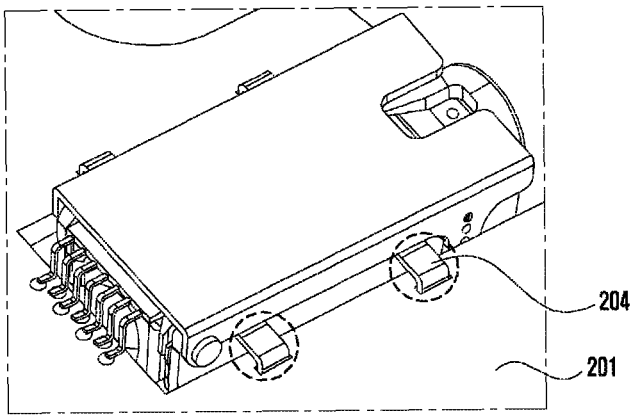

FIGS. 13A to 13C are perspective views illustrating an angle adjustable ear jack device mounted in a PCB-cutting type according to an exemplary embodiment of the present disclosure.

Referring to FIGS. 12A and 13A to 13C, when comparing FIG. 12A and FIG. 13A, the positions and shapes of the mounting portion 204 are different. That is, a method of mounting the angle adjustable ear jack device 300 in the PCB 201 may vary depending on the design and thickness of an electronic device. In this case, a position and a shape of the mounting portion 204 may be changed according to a method of mounting the angle adjustable ear jack device 300 in the PCB 201. FIG. 13B illustrates an example of a PC-cutting type that positions the angle adjustable ear jack device 300 in between the PCB by cutting a specific portion of the PCB 201. FIG. 13C illustrates a rear view of the PCB where the angle adjustable ear jack device 300 mounted in the PC-cutting type. In exemplary embodiments, the method of mounting in the PCB 201 of the angle adjustable ear jack device 300 is not limited to the on-board and PC-cutting type.

Figure 14A:
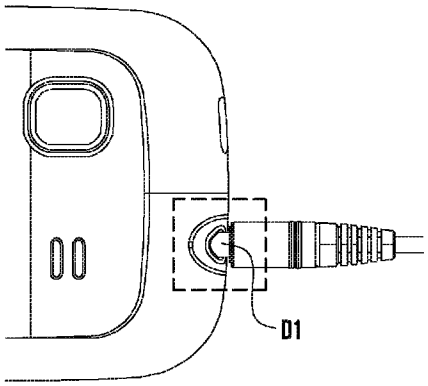
FIGS. 14A and 14B are cross-sectional views and plan views comparing an exposure level of an earphone plug after insertion according to an exemplary embodiment of the present disclosure.
Figure 14A:
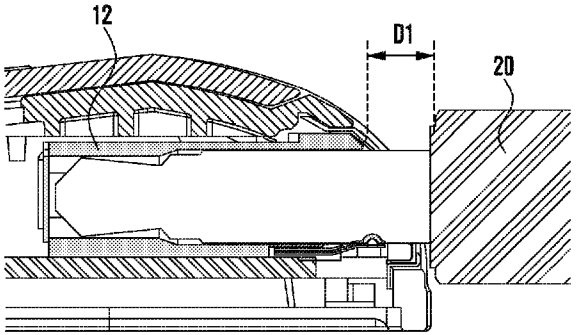
Figure 14B:
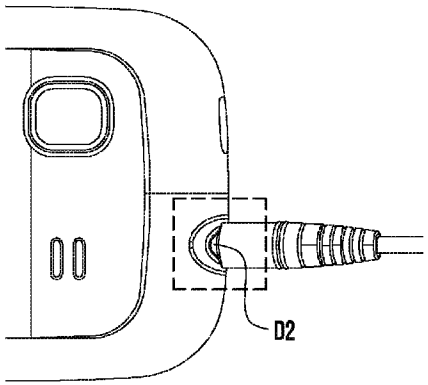
Figure 14B:
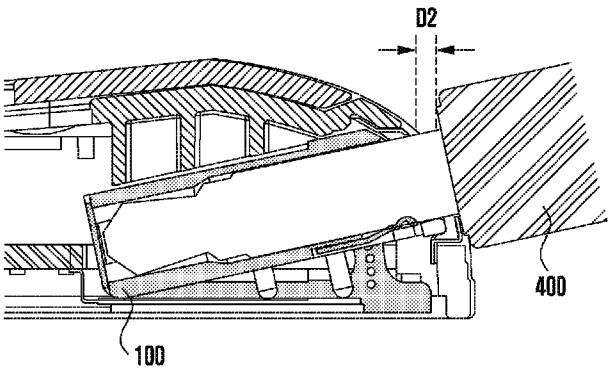

FIGS. 14A and 14B are cross-sectional views and plan views comparing an exposure level of an earphone plug after insertion according to an exemplary embodiment of the present disclosure.

Referring to FIG. 14A, an earphone plug exposure D1 exposed to the outside when the earphone plug 20 is inserted into the conventional jack 12 is shown. FIG. 14B shows an earphone plug exposure D2 exposed to the outside when an earphone plug 400 is inserted into the angle adjustable ear jack device 300 according to an exemplary embodiment of the present disclosure. Referring to FIG. 14B, when the angle adjustable ear jack device 300 is used, a mounting angle of the ear jack 100 may be adjusted to correspond to an external appearance design (e.g., a rounded surface design) of an electronic device, thereby minimizing the amount of the earphone plug exposure exposed to the outside.

Therefore, exemplary embodiments of the present disclosure prevent a user's misunderstanding that the earphone plug 400 is not completely inserted into the ear jack 100. Consequently, it can prevent components from being damaged and malfunction from occurring as a result of the forcible insertion.

According to exemplary embodiments of the present disclosure, by adjusting an angle of an ear jack through an ear jack device, an ear jack component may be standardized, and sharing of the ear jack can be enhanced. Further, by using one type of ear jack device in electronic devices having various designs, and without changing the ear jack according to an external appearance or design (e.g., a curved surface design) of an electronic device, the mounting ability of the ear jack may be enhanced and production costs may be reduced.

While the disclosure has been shown and described with reference to certain exemplary embodiments thereof, it will be understood by those skilled in the art that various changes in form and details may be made therein without departing from the spirit and scope of the disclosure as defined by the appended claims and their equivalents.

What is claimed is:

1. An angle adjustable ear jack device, the device comprising:

an ear jack unit capable of an angle adjustment and comprising an ear jack, a conductive elastic member and a metal portion;

an ear jack support unit for adjusting the angle of the ear jack unit; and at least one hinge for assembling the ear jack unit and the ear jack support unit, wherein the length of the conductive member increases or decreases according to change in a pressure and/or an angle applied to the ear jack.

2. The device of claim 1, wherein the conductive elastic member maintains contact with a land pad.

3. The device of claim 1, wherein the conductive elastic member transfers and receives an electric signal between the ear jack unit and an external device.

4. The device of claim 1, wherein the conductive elastic member includes a pogo pin.

5. The device of claim 1, wherein the ear jack unit further includes a fixing portion positioned at a side of the ear jack.

6. The device of claim 5, wherein the fixing portion is configured to fix the angle of the ear jack unit in association with an angle adjustment hole of an ear jack plate.

7. The device of claim 5, wherein the fixing portion includes a pogo pin.

8. The device of claim 1, wherein the ear jack support unit comprises an ear jack plate and a land pad.

9. The device of claim 8, wherein the ear jack plate includes a plurality of angle adjustment holes.

10. The device of claim 9, wherein the plurality of angle adjustment holes are configured to adjust the angle of the ear jack by bonding a fixing portion of the ear jack unit to at least one of the plurality of the angle adjustment holes.

11. The device of claim 8, wherein the ear jack plate has at least one mounting portion for mounting the ear jack plate in a Printed Circuit Board (PCB).

12. The device of claim 11, wherein the mounting portion mounts the ear jack plate in the PCB using a Surface Mount Device (SMD).

13. The device of claim 11, wherein the at least one mounting portion changes a position and a shape according to a type.

14. The device of claim 12, wherein the type includes an on-board type and a PCB-cutting type.

15. The device of claim 8, wherein the land pad transfers the electric signal of the ear jack unit to the PCB or to a plug of an external device.

16. The device of claim 8, wherein the land pad includes a plurality of contact lands.

17. The device of claim 16, wherein the plurality of contact lands make contact with the conductive elastic member, the contact lands being formed in a plug insertion direction in order to maintain the contact with the conductive elastic member even when the angle of the ear jack unit is changed.

18. The device of claim 1, wherein the at least one hinge functions as a rotation axis when the angle of the ear jack unit is adjusted.

* * * * *